US006716057B1

(12) United States Patent
Wu

(10) Patent No.: US 6,716,057 B1
(45) Date of Patent: Apr. 6, 2004

(54) CABLE END CONNECTOR ASSEMBLY WITH IMPROVED SHIELDING MEANS

(75) Inventor: Jerry Wu, Santa Clara, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/353,365

(22) Filed: Jan. 28, 2003

Related U.S. Application Data

(63) Continuation-in-part of application No. 10/264,650, filed on Oct. 3, 2002.

(51) Int. Cl.[7] ..... H01R 12/24
(52) U.S. Cl. ..... 439/497; 439/579; 439/608
(58) Field of Search ..... 439/493, 497, 439/579, 608

(56) References Cited

U.S. PATENT DOCUMENTS 5,267,874 A * 12/1993 Koegel et al. ..... 439/497
6,183,302 B1 2/2001 Daikuhara et al. ..... 439/608
6,419,502 B1 7/2002 Trammel ..... 439/79
2003/0064625 A1 * 4/2003 Ozai ..... 439/579

* cited by examiner

*Primary Examiner*—Michael C. Zarroli
(74) *Attorney, Agent, or Firm*—Wei Te Chung

(57) ABSTRACT

A cable end connector assembly (100) includes a base (2), a cover (1) fixed on the base, and a cable connector module (200) mounted between the cover and the base. The cable connector module includes a cable (4), a plurality of shielding plates (8), and a plurality of signal and grounding terminals (3, 6, 7, 9). The cable includes a plurality of lines (40) each having a first signal conductor (402) and a second signal conductor (404) located at an upper position and a lower position, respectively, and a grounding conductor (406). Each shielding plate defines a pair of notches (800) therein. Each grounding conductor is respectively received into and soldered with the corresponding notch. Each of the signal pairs is located between two neighboring shielding plates. The terminals are electrically connected with the grounding conductors and the signal conductors.

18 Claims, 14 Drawing Sheets

CABLE END CONNECTOR ASSEMBLY WITH IMPROVED SHIELDING MEANS

CROSS-REFERENCE TO RELATED APPLICATION

This patent application is a continuation-in-part co-pending application of U.S. patent application Ser. No. 10/264,650, filed on Oct. 3, 2002, invented by Jerry Wu, Yin-Tse Kao, An-jen Yang, Yuan-Chieh Lin and Jim Zhao, entitled "CABLE CONNECTOR HAVING IMPROVED CROSS-TALK SUPPRESSING FEATURE" and assigned to the same assignee as this patent application. This patent application is a co-pending application of U.S. patent application Ser. No. 10/264,384, filed on Oct. 4, 2002, invented by Jerry Wu, entitled "CABLE CONNECTOR ASSEMBLY" and assigned to the same assignee as this patent application. This patent application is a co-pending application of U.S. patent application Ser. No. 10/217,382, filed on Aug. 12, 2002, invented by Jerry Wu, entitled "ELECTRICAL CONNECTOR WITH IMPROVED GROUNDING TERMINAL ARANGEMENT" and contemporaneously application, invented by Jerry Wu, entitled "CABLE END CONNECTOR ASSEMBLY HAVING RELATIVELY SIMPLE STRUCTURE AND IMPROVED TERMINAL STRUCTURE" and all assigned to the same assignee as this patent application.

BACKGROUND OF THE INVENTION

Field of the Invention

The present invention relates to a cable end connector assembly, and particularly to a high speed cable end connector assembly for use in INFINIBAND™ application.

As demands for high bandwidth and low latency in computer technology increase, the emerging INFTNIBAND™ architecture is being developed by the information industry. INFINIBAND™ architecture de-couples an I/O subsystem from memory by utilizing point-to-point connections rather than a shared bus. InfiniBand™ products are ideally suited for clustering, I/O extensions, and native attachment in many network applications and can be used in high-performance server applications, providing a cost-effective transition from existing technologies.

To achieve the technology performance of the INFINIBAND™ architecture, an INFINIBAND™ product must provide a sufficiently large number of signal contacts with a fairly fine pitch for signal transmission. Thus, the InfiniBand™ product has a relatively complex structure. An INFINIBAND™ cable end connector assembly comprises a base, a cover mounted to the base, and a cable connector module assembled between the cover and the base. The cable connector module comprises a cable accommodating a plurality of lines each comprising a signal pair and a grounding conductor, a plurality of shielding plates respectively electrically connecting with the grounding conductors, a plurality of spacers to which the lines and the shielding plates are assembled, and a plurality of signal and grounding terminals. The signal pairs of the cable and the shielding plates are respectively soldered on signal and grounding traces disposed on a rear end of an inner circuit board. Rear ends of the signal and grounding terminals are soldered on a front end of the inner circuit board. Thus, the signal pairs of the cable electrically connect with the signal terminals, and the grounding conductors electrically connect with the grounding terminals via the shielding plates. However, the existence of the spacers inevitably complexes the structure of the InfiniBand™ cable end connector assembly and increases the manufacturing cost. This is no doubt out of the current trend.

Hence, a cable end connector assembly for INFINIBAND™ application with a relatively simple structure and lower manufacturing cost Is required to overcome the disadvantages of the related art.

SUMMARY OF THE INVENTION

A first object, therefore, of the present invention is to provide a cable end connector assembly with a relatively simple structure and a lower cost.

A second object of the present invention is to provide a cable end connector assembly having an improved grounding plate structure which can terminate a grounding wire of a cable conveniently.

In order to achieve the objects set forth, a cable end connector assembly comprises a base, a cover fixed on the base, and a cable connector module mounted between the cover and the base. The cable connector module comprises a cable, a plurality of shielding plates, and a plurality of terminals. The cable comprises a plurality of lines each having a signal pair and a grounding conductor. The signal pair comprises a first signal conductor and a second signal conductor. Each shielding plate defines a retaining portion. The grounding conductors are respectively received into and soldered with the retaining portions. Each of the signal pairs is located between two neighboring shielding plates. The first and second signal conductors of each of the signal pairs are located at an upper position and a lower position, respectively. The terminals are electrically connected with the grounding conductors and the signal conductors.

Other objects, advantages and novel features of the invention will become more apparent from the following detailed description when taken in conjunction with the accompanying drawings.

DETAILED DESCRIPTION OF THE INVENTION

Figure 1:
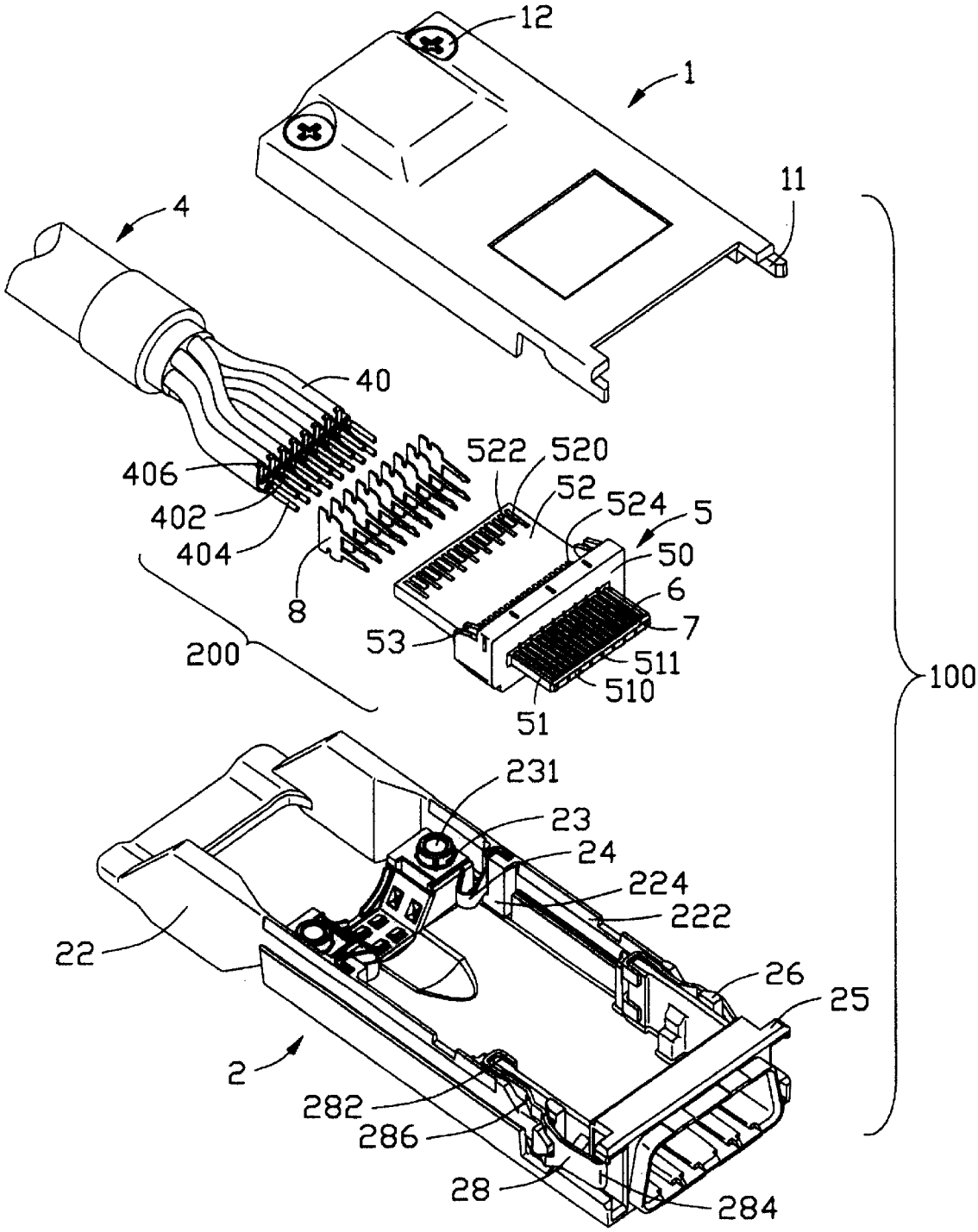
FIG. 1 is an exploded, perspective view of a cable end connector assembly in accordance with the present invention.
Figure 2:
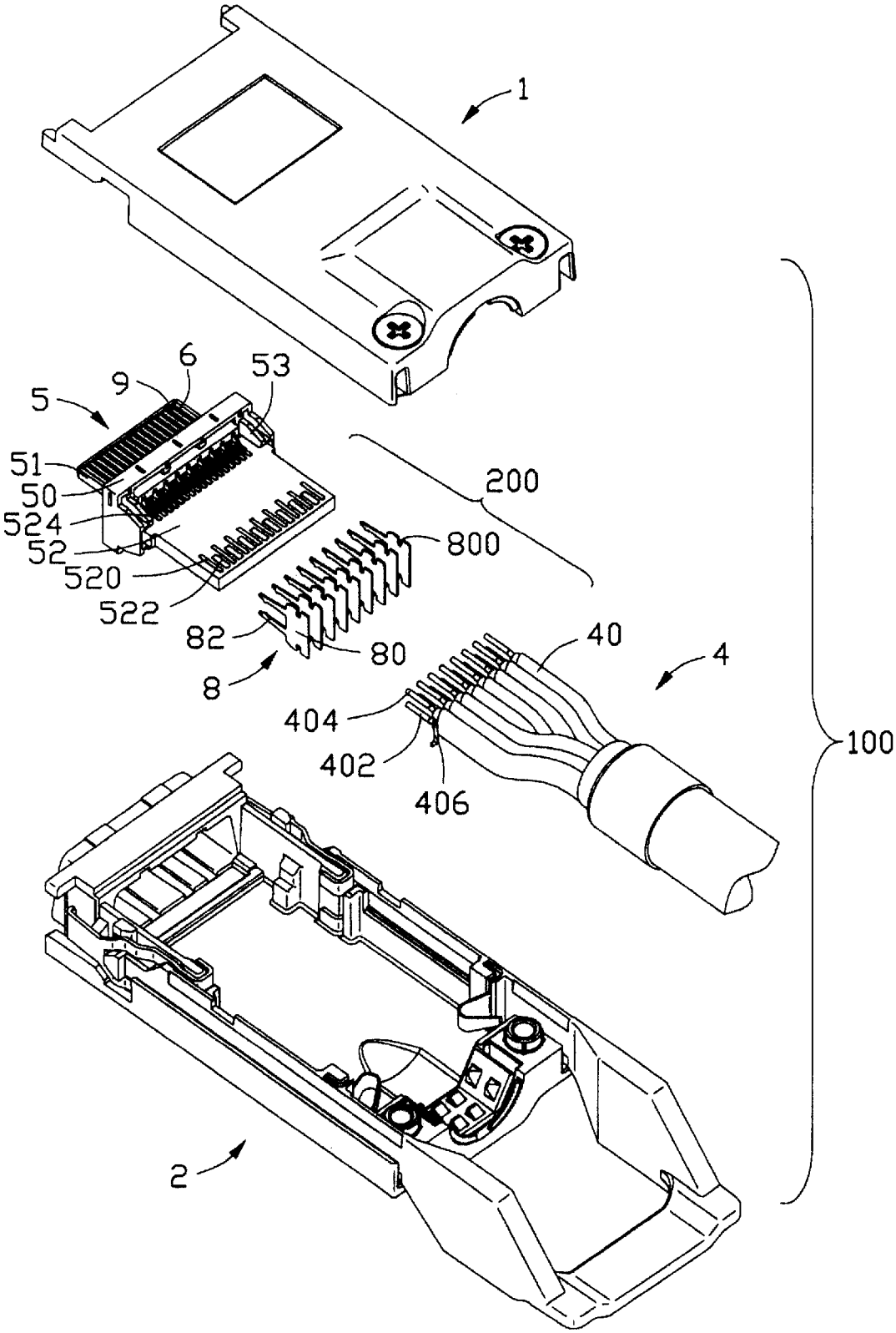
FIG. 2 is a view similar to FIG. 1, but taken from rear and bottom aspects.
Figure 6:
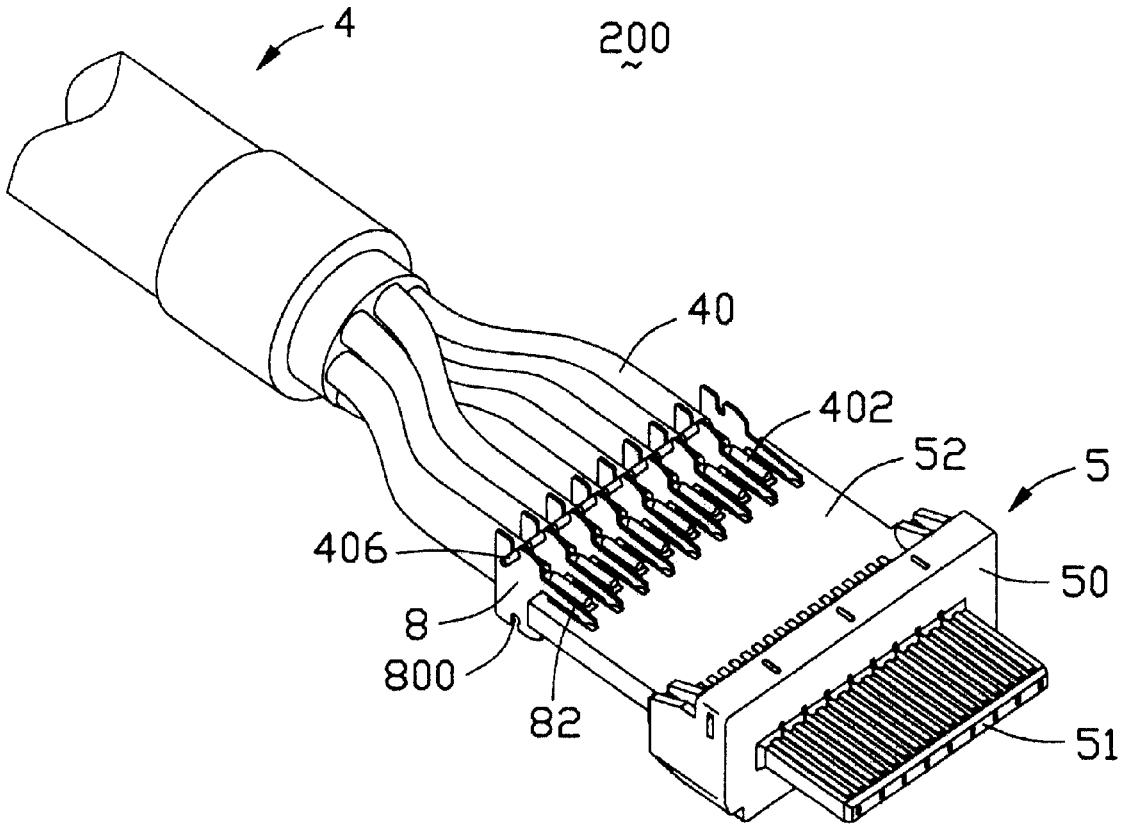
FIG. 6 is an assembled, perspective view of the cable connector module of FIG. 1.
Figure 7:
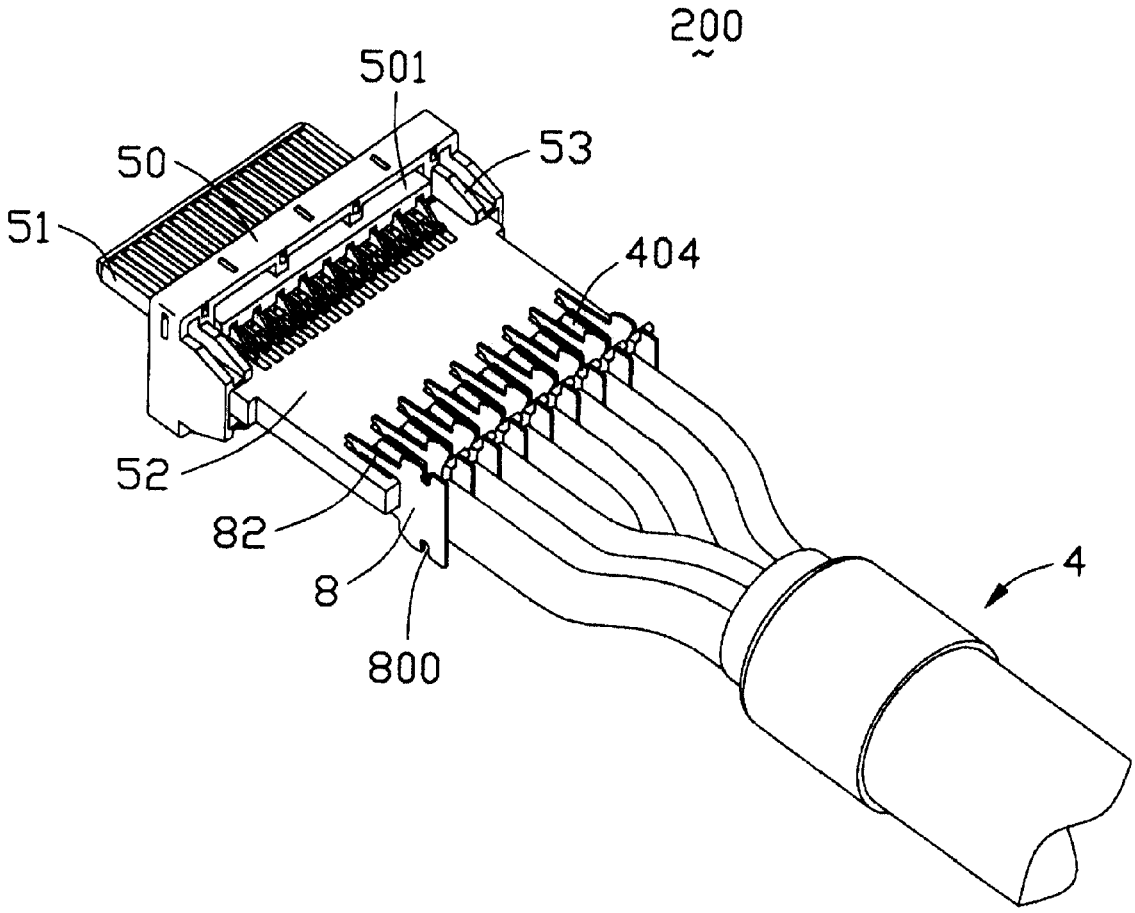
FIG. 7 is a view similar to FIG. 6, but taken from rear and bottom aspects.
Figure 8:
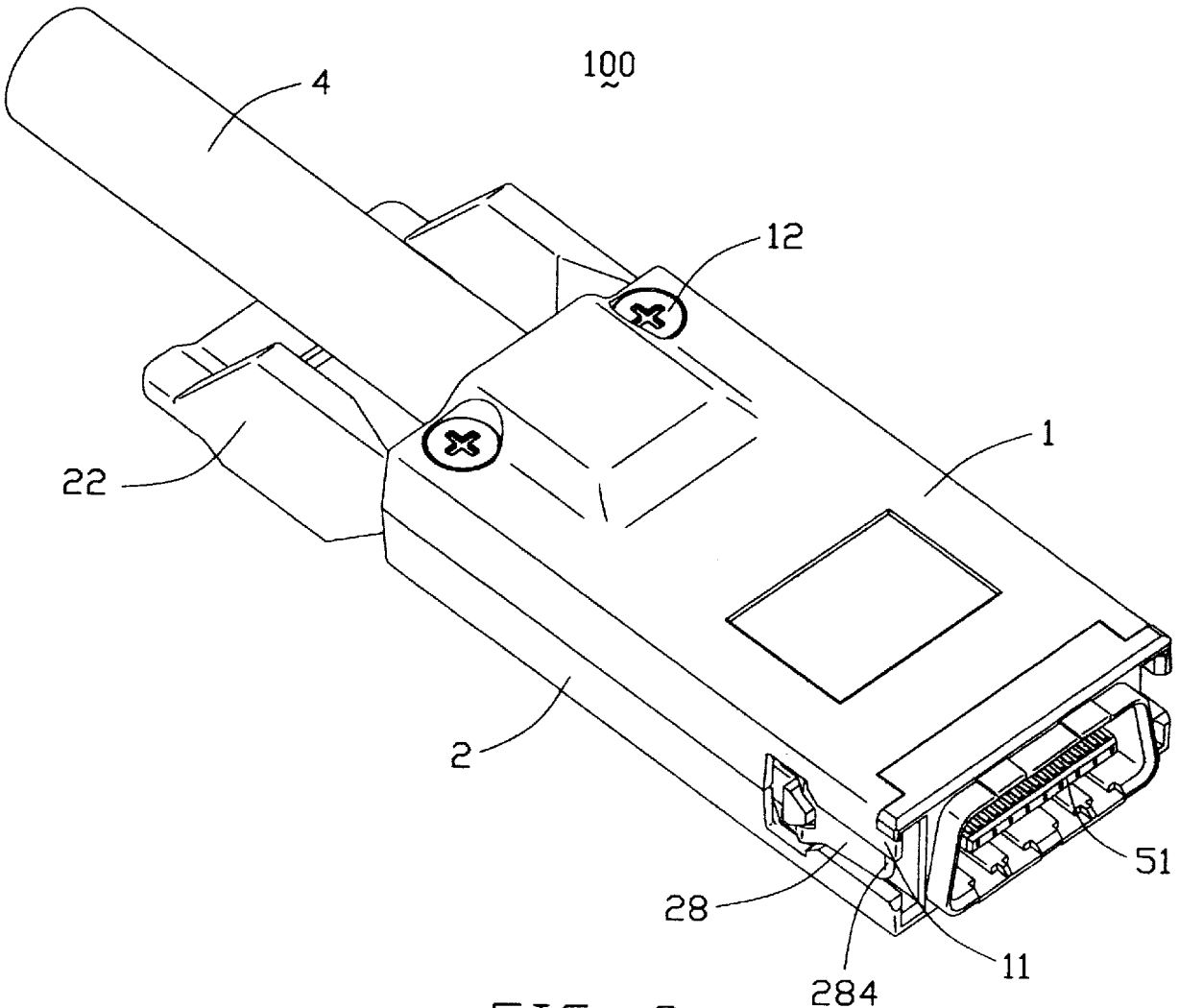
FIG. 8 is an assembled, perspective view of the cable end connector assembly of FIG. 1.
Figure 9:
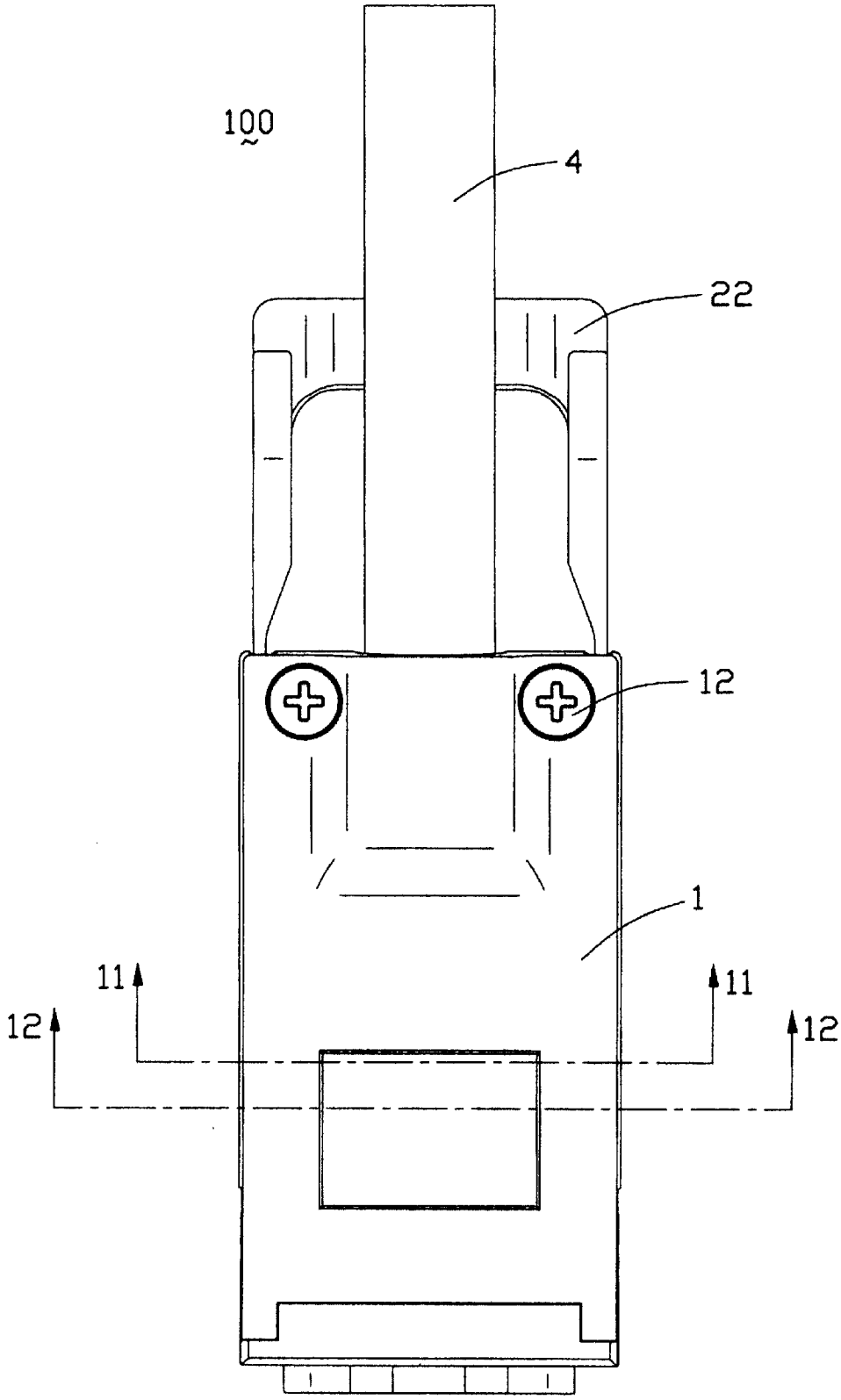
FIG. 9 is a top plan view of the cable end connector assembly of FIG. 8.
Figure 10:
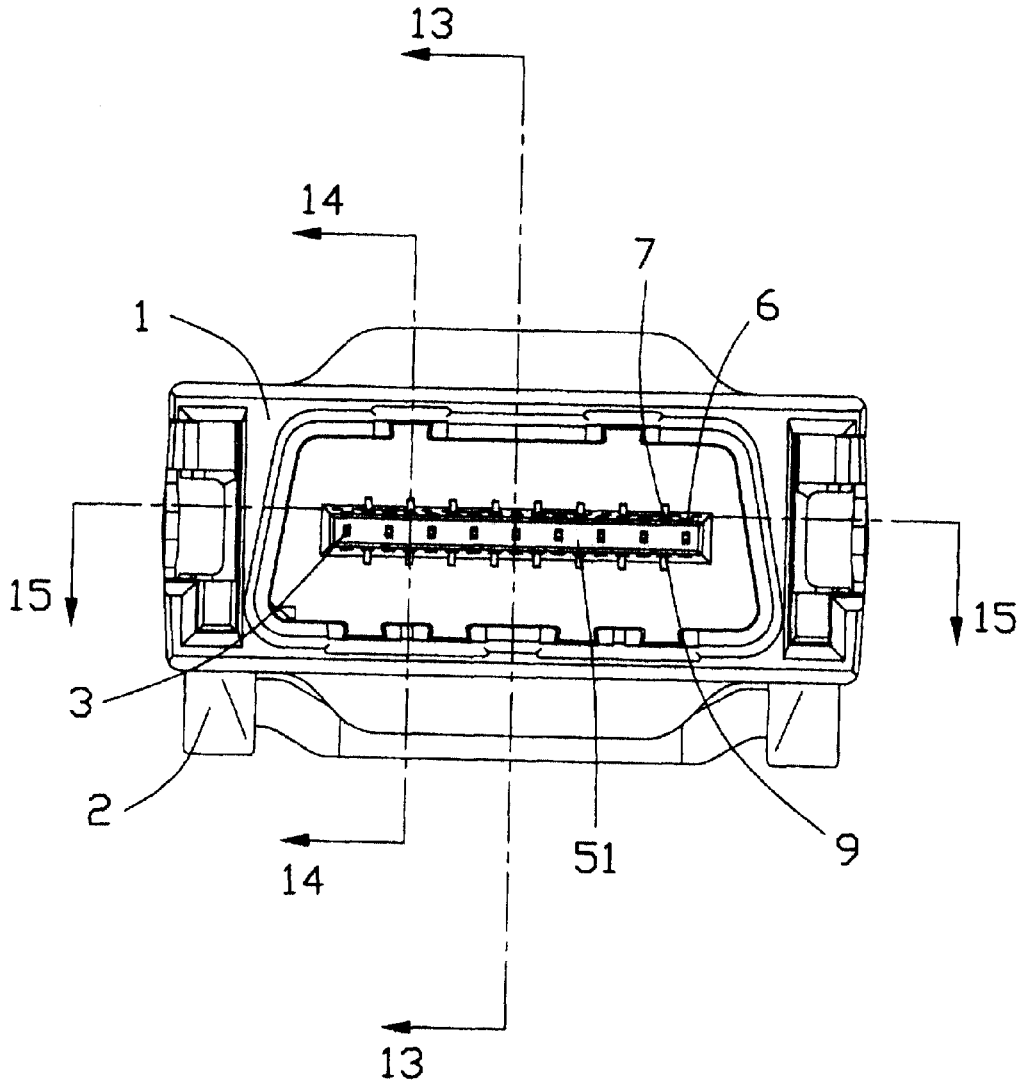
FIG. 10 is an elevational view of the cable end connector assembly of FIG. 8.
Figure 11:
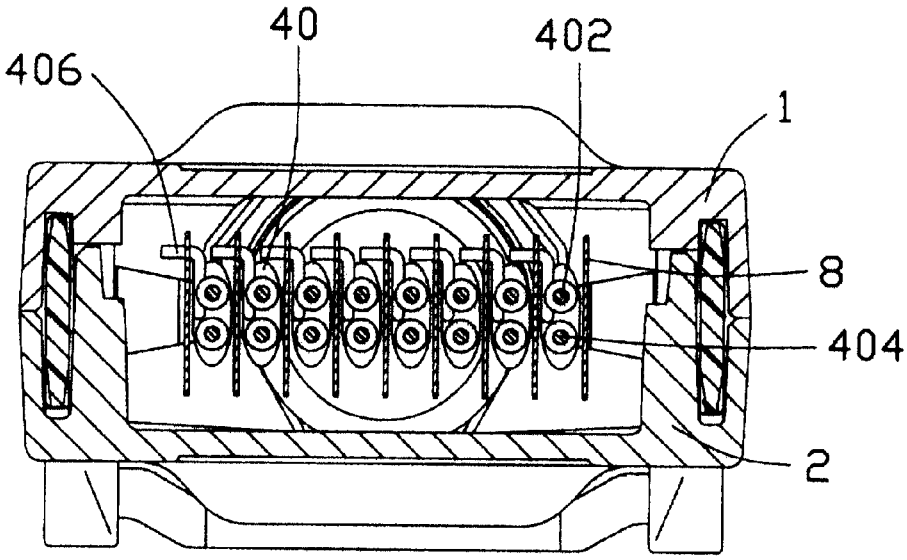
FIG. 11 is a cross-sectional view taken along line 11—11 of FIG. 9.
Figure 12:
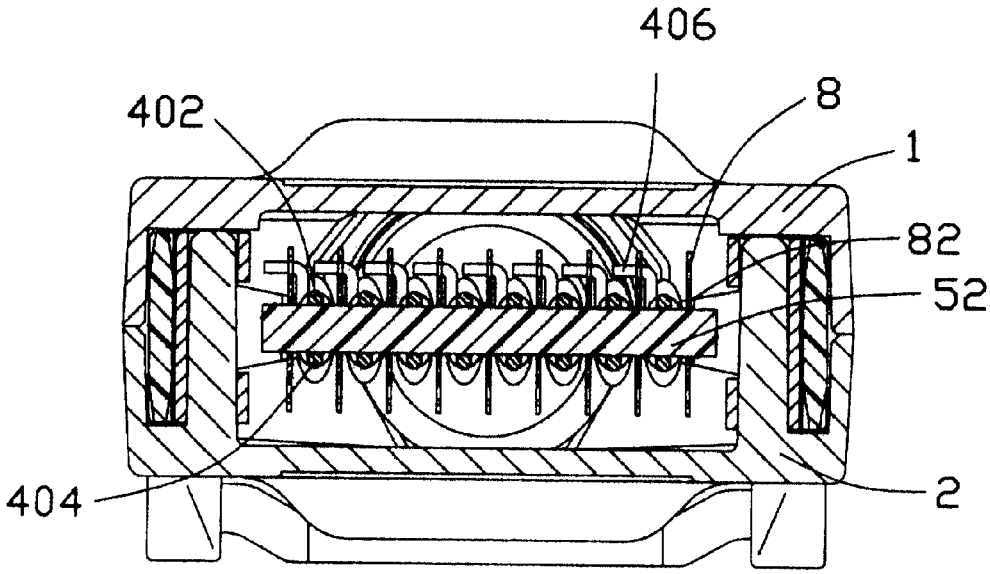
FIG. 12 is a cross-sectional view taken along line 12—12 of FIG. 9.

Referring to FIGS. 1 and 2, and in conjunction with FIGS. 6 and 7, a cable end connector assembly 100 for use in an INFINIBAND™ application in accordance with the present invention comprises a cover 1, a base 2, and a cable connector module 200 located between the cover 1 and the base 2.

Also referring to FIGS. 1 and 2, the cable connector module 200 includes a cable 4 accommodating eight lines 40 therein, a housing 5, a plurality of signal and grounding terminals, and a plurality of shielding plates 8.

Each line 40 has an elliptical profile and comprises a differential pair of signal conductors 402, 404 and a grounding conductor 406. The signal conductors 402, 404 of the signal pair of each line 40 are so arranged that they are vertically aligned with each other. The grounding conductor 406 of each line 40 is located between and on topside of every two neighboring signal pairs.

The housing 5 comprises a body 50, a tongue 51 projecting forwardly from the body 50, a pair of leading arms 53 extending from both sides of the body 50, and an inner circuit board 52 disposed between the pair of leading arms 53 and adjacent to a rear portion of the body 50. The body 50 forms a pair of ribs 501 extending rearwardly therefrom. The ribs 501 further define a rear surface 502. The tongue 51 defines a front surface 510 parallel to the rear surface 502. Nine passages 512 are defined through the tongue 51. Eight passageways 514 are defined between every two adjacent passages 512 and at opposite upper and lower sides of the tongue 51.

Figure 3:
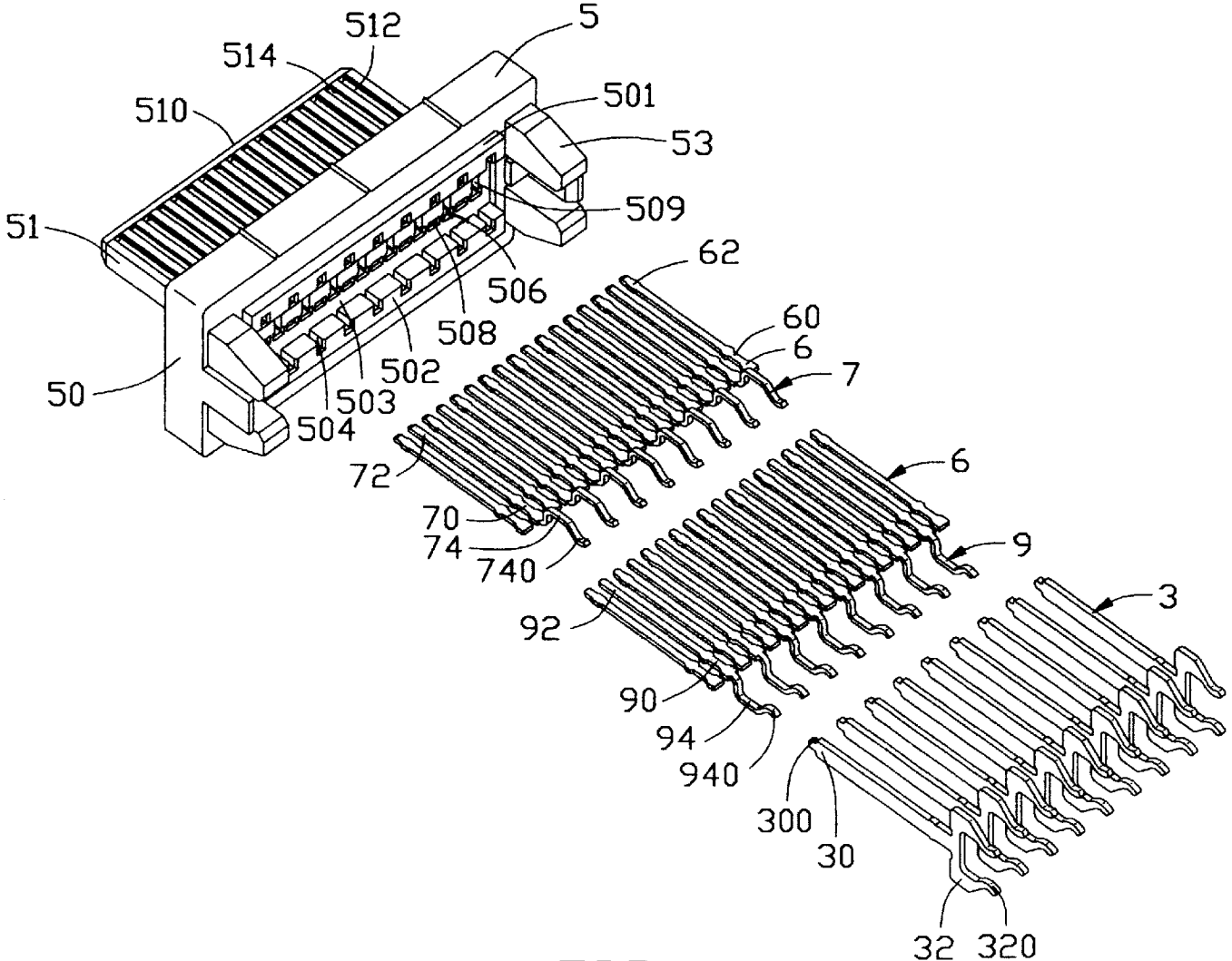
FIG. 3 is a partly exploded, perspective view of a cable connector module of the cable end connector assembly shown in FIG. 2.
Figure 4:
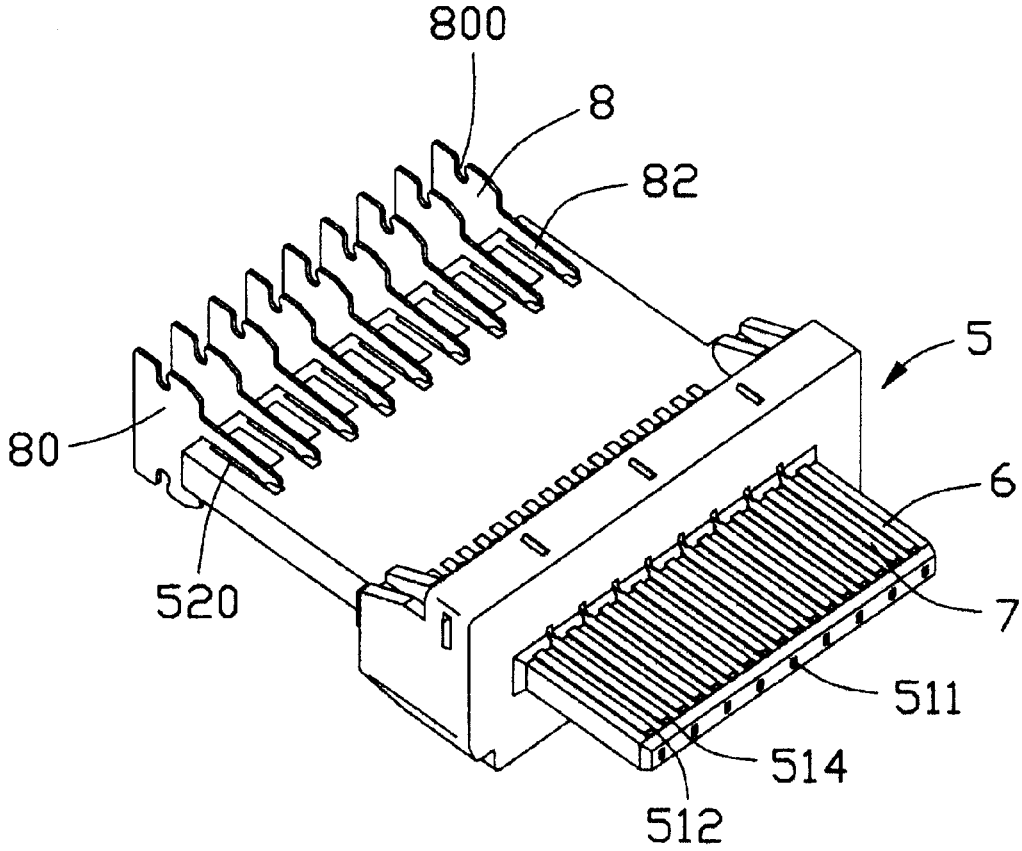
FIG. 4 is a partly assembled view of the cable connector module of FIG. 1.
Figure 5:
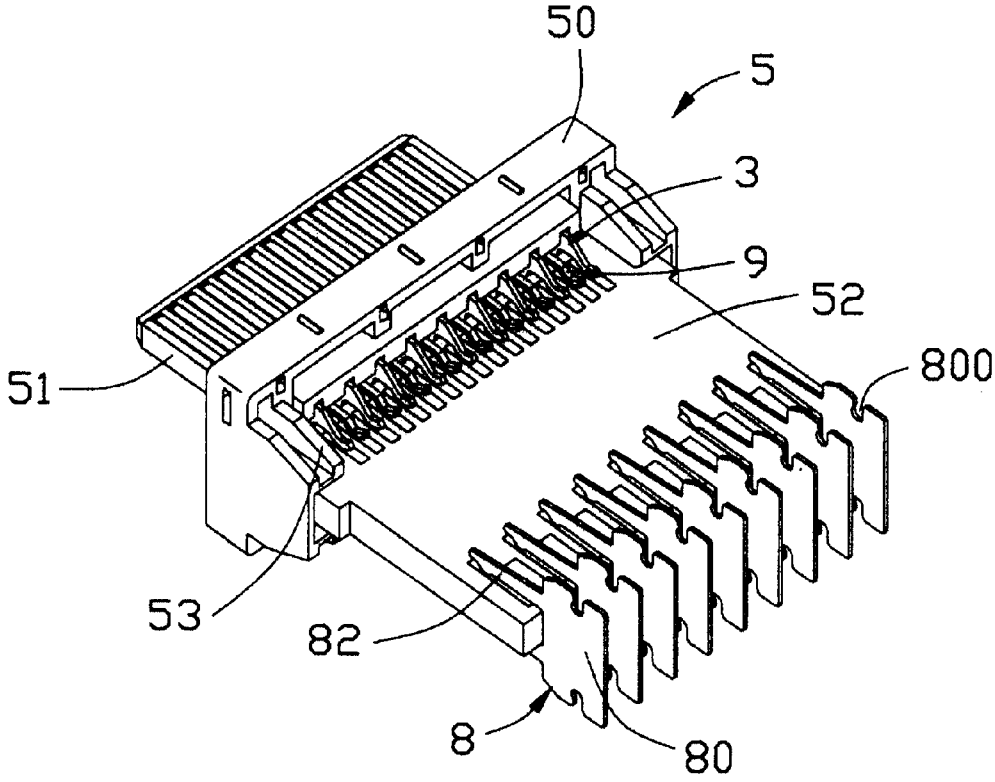
FIG. 5 is a view similar to FIG. 4, but taken from rear and bottom aspects.

Referring to FIG. 3, each rib 501 defines nine recesses 504. The body 50 further defines a receiving cavity 503 between the pair of ribs 501 at the rear portion thereof. Nine grooves 506 are defined through the body 50 and respectively communicate with the passages 512. Nine slots 509 are defined through the body 50 and communicate with the passages 512, respectively. Each pair of grooves 506 locates above and below corresponding slot 509 and communicates with the slot 509. Eight through holes 508 are defined through the body 50 and communicate with the passageways 514, respectively. Specially, each recess 504 is aligned with corresponding slot 509 in a vertical direction. Furthermore, the tongue 51 defines a plurality of holes 511 to provide each passage 512 an opening to the front surface 510 thereof. The passages 512 and the grooves 506 together define a contact-receiving space for receiving grounding terminals, the passageways 514 and the through holes 508 together define a contact-receiving space for receiving signal terminals.

The inner circuit board 52 comprises a pair of opposite front and rear ends. A plurality of circuitries 524 is formed on opposite top and bottom surfaces of the front end of the circuit board 52, and a plurality of grounding traces 520 is formed on opposite top and bottom surfaces of the rear end. A plurality of signal traces 522 is formed between every two neighboring grounding traces 520.

Terminals include nine first grounding terminals 3, eighteen second grounding terminals 6 arranged in two rows, eight first signal terminals 7, and eight second signal terminals 9. Referring to FIG. 3 please, each first grounding terminal 3 includes a limb 30 and a pair of wings 32 extending from an end of the limb 30, and the limb 30 defines a tip 300 at one end thereof. Each wing 32 defines an engaging portion 320. Each second grounding terminal 6 includes a retention portion 60 for retaining the terminal 6 in the housing 5, and a contact portion 62 for engaging a complementary connector. Each first signal terminal 7 includes a retention portion 70, a contact portion 72, and a curved portion 74 extending upwardly from the retention portions 70. The curved portion 74 further defines an engaging portion 740 for connecting the circuit board 52. Each second signal terminal 9 includes a retention portion 90, a contact portion 92, and a curved portion 94 extending downwardly from the retention portion 90. The curved portion 94 further defines an engaging portion 940 for connecting the circuit board 52. In addition, the length of the second grounding terminal 6 is equal to the length of the retention portion 70, 90 plus the contact portion 72, 92 of each first and second signal terminal 7 and 9. Furthermore, in assembly, the contact portions 62, 72, 92 of the second grounding terminals 6 and the first and second signal terminals 7, 9 each has a flat shape and is arranged in a plane which is parallel to an upper surface of the body 50, while the limb 30 of the first grounding terminal 3 has also flat shape but being arranged in a plane which is perpendicular to the upper surface of the body 50. In order to improve impedance of the terminals, the contact portions must be plated a layer gold. Regarding cost of plating, only ends of the contact portions are plated a layer gold here.

Each shielding plate 8 includes a flat-shape main portion 80 and a pair of bifurcated upper and lower fingers 82 extending forwardly from a front edge of the main portion 80 for engaging the inner circuit board 52. A pair of notches 800 is defined in upper and lower edges of the main portion 80, respectively.

Figure 13:
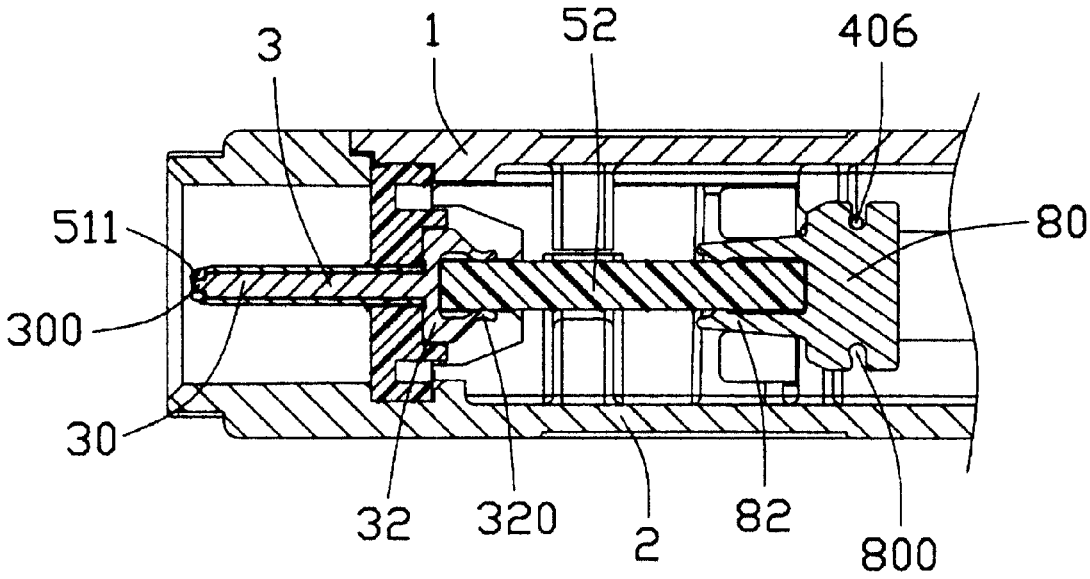
FIG. 13 is a partly cross-sectional view taken along line 13—13 of FIG. 10.
Figure 14:
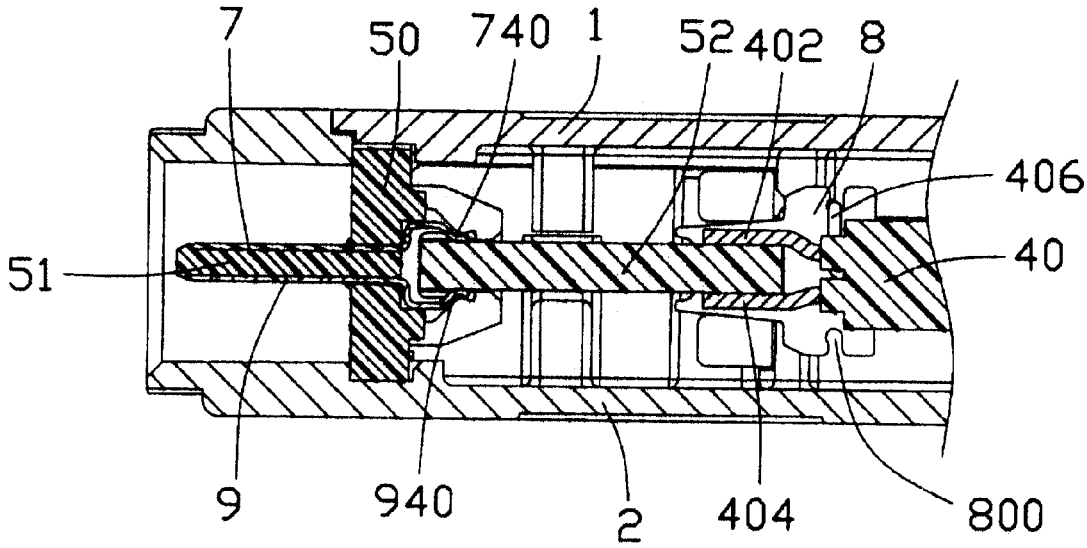
FIG. 14 is a partly cross-sectional view taken along line 14—14 of FIG. 10.
Figure 15:
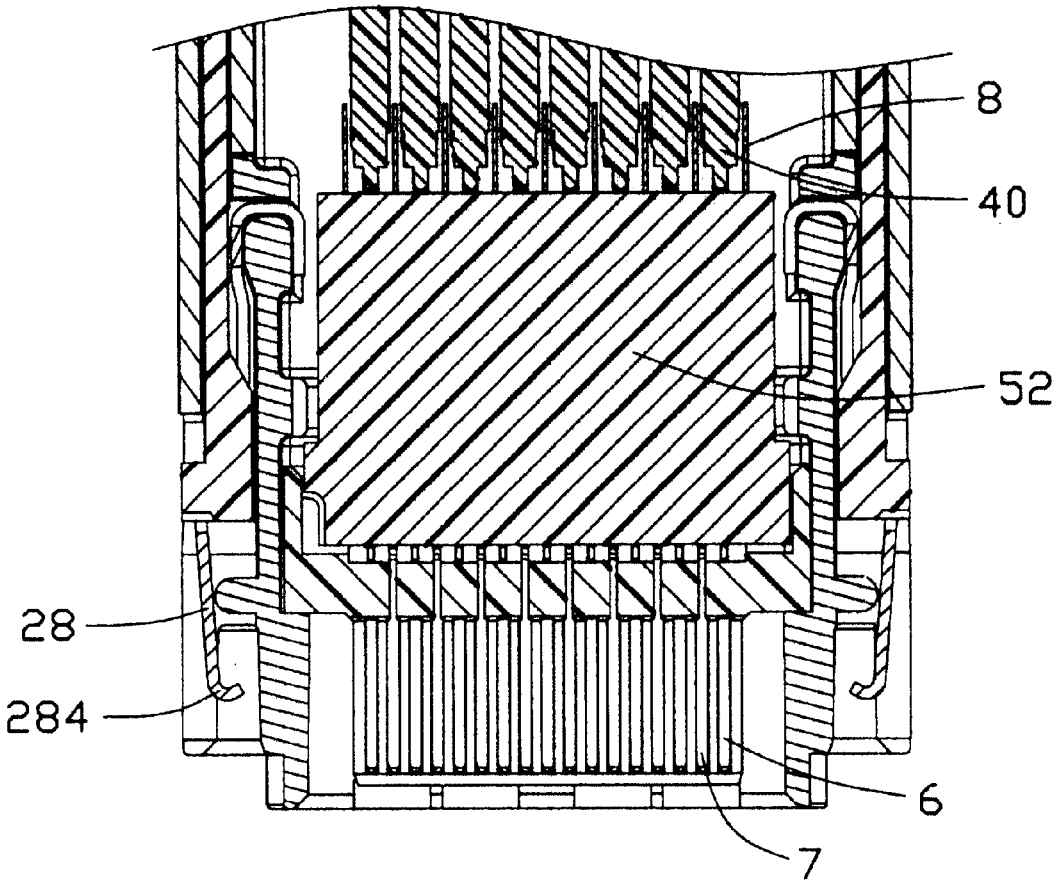
FIG. 15 is a partly cross-sectional view taken along line 15—15 of FIG. 10.

Referring to FIGS. 1 and 2, and in conjunction with FIGS. 13 to 15, in assembly, the signal terminals 7, 9 and the grounding terminals 3, 6 are respectively inserted into the housing 5. The second grounding terminals 6 are firstly inserted into the grooves 406 of the body 50 and further entirely in the passages 512 of the tongue 51 in pairs. The first and second signal terminals 7, 9 are inserted into the through holes 508 of the body 50 and further in the passageways 514 of the tongue 51. The flat contact portions 62, 72, 92 are arranged in both surfaces of the tongue 51 thereby providing enough surfaces for engaging the complementary connector. Subsequently, the first grounding terminal 3 is inserted into corresponding slot 509 communicating with corresponding pair of grooves 506 of the body 50 and further into the passage 512 until the tip 300 extends into corresponding hole 511 of the tongue 51, wherein the limb 30 engage every pair of second grounding terminals 6 located above and below the first grounding terminal 3, and the wings 32 are retained in the recesses 504 to prevent unnecessary deformation. Then the wings 32 of the first grounding terminals 3, and the curved portions 74, 94 of the first and second signal terminals 7, 9 are disposed in the receiving cavity 503 of the body 50 and beyond the rear surface 502. Thus, the circuit board 52 can be retained between the pair of leading arms 53, and between the wings 32 and the curved portions 74, 94 via soldering the engaging portions 320, 740, 940 to the circuitries 524 disposed on the front end thereof. Finally, in insertion direction and perpendicular to the upper surface of the body 50, the wings 30 each has a bigger surface relative to the curved portions 74, 94 thereby providing better grounding protection to signal transmission.

Now referring to FIGS. 4 to 7, and in conjunction with FIGS. 13 to 15, the bifurcated upper and lower fingers 82 of the shielding plates 8 are respectively soldered on the grounding traces 520 disposed on the rear end of the circuit board 52. Then, the signal pair of conductors 402, 404 is respectively soldered on the signal traces 522. Thus, the first and second signal terminals 7, 9 respectively electrically connect with the signal conductors 402, 404 via the circuit board 52. The grounding conductor 406 of each line 40 is received and soldered in one notch 800 of corresponding shielding plate 8. Thus, the first grounding terminals 3 electrically connect with the grounding conductors 406 of the cable 4 via the circuit board 52, whereby providing better grounding protection to the cable end connector assembly 100. Therefore, the assembly of the cable connector module 200 is finished. Referring back to FIGS. 1 and 2, and in conjunction with FIGS. 8–15, both the cover 1 and the base 2 are formed by die casting of metal such as aluminum alloy. The cover 1 is provided with a pair of screws 11 for screwing into screw holes 231 defined in studs 23 formed in the base 2 after the cable connector module 200 is put in the base 2 to thereby assemble the cover 1, the cable connector module 200, and the base 2 together. To mount the cover 1 to the base 2, firstly protrusions 12 formed on a front end of the cover 1 are positioned below side flanges 25 formed on a front end of the base 2, respectively. Then a rear end of the cover 1 on which the screws 31 are located is pivoted downwardly about the flanges 25 toward the base 2 until the rear end of the cover 1 is in contact with a rear end of the base 2. The cable end connector assembly 100 is further provided with a pull tab 22 movably mounted between the cover 1 and the base 2 for releasing a latch between the cable end connector assembly 100 and the complementary connector.

The pull tab 22 has two arms 222 extending forwardly, each arm 222 forming a mounting block 224 at an inner side of a rear portion thereof and a driving block 26 at the inner side of a front end thereof. A pair of latches 28 is mounted on a front portion of lateral walls of the base 2. Each latch 28 has a hooked front end 284 for latching with the complementary connector when the cable end connector assembly 100 in accordance with the present invention mates with the complementary connector, a rear end 282 fixedly secured to the base 2, and a cam portion 286 formed between the hooked front end 284 and the rear end 282. The cam portion 286 has an inner face abutting against the driving block 26 of a corresponding arm 222 of the pull tab 22. The cam portion 286 has an inwardly, rearwardly stepped configuration, whereby when the driving block 26 moves rearwardly as the pull tab 22 is pulled rearwardly, the driving block 26 causes the cam portion 286 and thus the hooked front end 284 to move laterally outwardly, thereby to release the latch between the cable end connector assembly 100 and the complementary connector. A pair of leaf springs 24 is provided with the cable end connector assembly 100 wherein each spring 24 has a front end fixed in the mounting block 224 of a corresponding arm 222 of the pull tab 22, and a rear end fixed to the base 2. When the pull tab 22 is pulled rearwardly, the springs 24 are compressed. When the pulling force is released, the springs 24 return to their original configurations, thereby motivating the pull tab 22 to return to its original position prior to being pulled. Thus, the latches 28 return to their original position as shown in FIG. 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly, comprising:

a base;

a cover fixed on the base; and a cable connector module mounted between the cover and the base, comprising;

a housing;

a cable comprising a plurality of lines each having a signal pair and a grounding conductor, the signal pair having a first signal conductor and a second signal conductor;

a plurality of shielding plates each comprising a main portion, a pair of bifurcated upper and lower fingers extending forwardly from the main portion, and a pair of notches defined in an upper edge and a lower edge of the main portion, the grounding conductors being respectively received into and soldered within the notches of corresponding shielding plates, each of the signal pairs being located between two neighboring shielding plates, wherein the first and second signal conductors of said each of the signal pairs are located at an upper position and a lower position, respectively; and a plurality of terminals respectively received in the housing and electrically connected with the grounding conductors and the signal conductors.

2. The cable end connector assembly as claimed in claim 1, wherein main portion of the shielding plate has a height larger than a vertical distance between the first and second signal conductors of each signal pair.

3. The cable end connector assembly as claimed in claim 1, further comprising a printed circuit board to which the signal conductors, the upper and lower fingers of the shielding plates and the terminals are soldered.

4. The cable end connector assembly as claimed in claim 3, wherein the housing of the cable connector module comprises an insulative body having a rear end to which the printed circuit board is fixed and a tongue extending forwardly from the insulative body, the terminals being received in upper and lower sides of the tongue.

5. The cable end connector assembly as claimed in claim 4, wherein a plurality of passages is defined through the tongue, a plurality of passageways is defined between every two neighboring passages and in opposite upper and lower sides of the tongue, the terminals comprise a plurality of signal terminals respectively received in the passageways and a plurality of second grounding terminals respectively received in the passages in pairs.

6. The cable end connector assembly as claimed in claim 5, wherein the terminals further comprise a plurality of first grounding terminals, a plurality of slots defined through the body and communicating with the passages, respectively, each first grounding terminal protrudes through corresponding slot and is further received in corresponding passages in pairs.

7. The cable end connector assembly as claimed in claim 6, wherein each first grounding terminal comprises a limb received in the passage and engaging corresponding pair of second grounding terminals, and a pair of wings extending rearwardly from the limb and soldered to the printed circuit board.

8. The cable end connector assembly as claimed in claim 7, wherein the limb of each first grounding terminal further forms a tip in a front end thereof, and the tongue defines a plurality of holes communicating with the passages, the tip of each limb is received in corresponding hole.

9. The cable end connector assembly as claimed in claim 1, further comprising a pair of metal latches locating at a front end of lateral walls of the base adapted for latching with the complementary connector, and a pull tab having a pair of driving blocks in engaging with the metal latches, respectively, said driving blocks driving said latches to move in a direction for releasing the latch between the cable end connector assembly and the complementary connector when the pull tab is pulled rearwardly.

10. The cable end connector assembly as claimed in claim 1, further comprising at least one resilient member which is deformed when the pull tab is pulled.

11. The cable end connector assembly as claimed in claim 10, wherein the base and the cover are made of metal.

12. A cable end connector assembly, comprising:

a base;

a cover fixed to the base; and a cable connector module mounted between the base and the cover, comprising:

a housing;

a cable including a plurality of lines each including a grounding conductor and a signal pair including an upper and a lower signal conductors;

a plurality of shielding plates each comprising a retaining portion, the grounding conductors being respectively received in the retaining portions and in electrical connection with the shielding plates;

a printed circuit board having a front end and an opposite rear end with which the shielding plates and the signal pairs are in electrical connection in such matter that each signal pair is located between two neighboring shielding plates, the upper signal conductors being in electrical connection with an upper surface of the printed circuit board while the lower signal conductors are in electrical connection with a lower surface of the printed circuit board; and a plurality of terminals respectively received in the housing and each having a rear end in electrical connection with the front end of the printed circuit board and a front end adapted for electrically engaging with a complementary connector.

13. The cable end connector assembly as claimed in claim 12, wherein each shielding plate comprises a main portion and an upper and a lower fingers extending forwardly from the main portion, the retaining portion is a pair of notches defined in an upper edge and a lower edge of the main portion.

14. The cable end connector assembly as claimed in claim 13, wherein the grounding conductor is received in and soldered with one notch of the shielding plate-thereby establishing electrical connection therebetween.

15. The cable end connector assembly as claimed in claim 12, wherein the printed circuit board extends in a horizontal direction and the shielding plates each extends in a vertical direction.

16. A cable end connector assembly comprising:

a cover assembly;

a cable connector module retained in the cover assembly and comprising:

a housing;

an internal printed circuit board located on a rear portion of the housing;

a plurality of terminals retained in the housing and mechanically and electrically connected to a front portion of the printed circuit board;

a cable including a plurality of lines each having a pair of signal conductors and a grounding conductor; and a plurality of vertical shielding plates retained on a rear portion of the printed circuit board in a spatial relation with one another; wherein a front portion of each of said lines is located between the adjacent two shielding plates under a condition that the corresponding signal conductor of each of said lines is soldered on two opposite surfaces of the rear portion of the printed circuit board along a front-to-back direction without contacting each of said two adjacent shielding plates, while at least one of the corresponding grounding conductor of each of said lines and the adjacent shielding plate extends in a lateral direction perpendicular to said front-to-back direction, toward the other to be mechanically and electrically retained to the other.

17. The cable end connector assembly as claimed in claim 16, wherein said grounding conductor extends in said lateral direction toward the corresponding adjacent shielding plate and is retained in a notch of said corresponding shielding plate.

18. The cable end connector assembly as claimed in claim 17, wherein said notch communicates with an exterior in both a vertical and said lateral direction.

* * * * *